US011424576B2

(12) United States Patent
Lalinde et al.

(10) Patent No.: US 11,424,576 B2
(45) Date of Patent: Aug. 23, 2022

(54) RETENTION DEVICES

(71) Applicant: Hewlett-Packard Development Company, L.P., Spring, TX (US)

(72) Inventors: Paul Roberto Lalinde, Spring, TX (US); Manjunath Bhat, Spring, TX (US); Daniel James Braden, Spring, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/047,127

(22) PCT Filed: Apr. 30, 2018

(86) PCT No.: PCT/US2018/030322

§ 371 (c)(1),
(2) Date: Oct. 13, 2020

(87) PCT Pub. No.: WO2019/212526

PCT Pub. Date: Nov. 7, 2019

(65) Prior Publication Data

US 2021/0203102 A1 Jul. 1, 2021

(51) Int. Cl.
*H01R 13/639* (2006.01)

(52) U.S. Cl.
CPC ..... *H01R 13/639* (2013.01)

(58) Field of Classification Search
CPC ..... H01R 13/639
USPC ..... 439/369
See application file for complete search history.

(56) References Cited

U.S. PATENT DOCUMENTS 714,869 A * 12/1902 Cravens
1,495,153 A * 5/1924 Benjamin ..... H01R 13/055 439/692
2,124,207 A * 7/1938 Neesen ..... H01R 24/84 439/284
2,130,424 A * 9/1938 Grant ..... H01R 33/94 439/692
2,248,082 A * 7/1941 Herman ..... H01R 13/20 439/697
2,281,739 A * 5/1942 Wright ..... H01R 13/71 439/271
2,895,119 A * 7/1959 Montgomery, Jr. ..... H01R 13/6275 439/354
3,184,703 A 5/1965 Piscitello et al.
3,543,218 A * 11/1970 Archer ..... H01R 13/20 439/346
4,183,603 A 1/1980 Donarumme
4,221,449 A * 9/1980 Shugart, Jr. ..... H01R 13/6392 439/369
4,284,318 A * 8/1981 Wiley ..... H01R 24/30 439/472

(Continued)

FOREIGN PATENT DOCUMENTS

WO WO-0129932 4/2001

*Primary Examiner* — Neil Abrams
(74) *Attorney, Agent, or Firm* — Brooks Cameron & Huebsch PLLC

(57) ABSTRACT

Example implementations relate to retention devices. A retention device may comprise a first end coupled to a connector housing of a first cable and a second end removably coupleable to a second cable to lock the first cable to the second cable when the first cable and the second cable are in an engaged position.

16 Claims, 4 Drawing Sheets

(56) References Cited

U.S. PATENT DOCUMENTS

| | | | | |
|---|---|---|---|---|
| 4,690,482 | A | 9/1987 | Chamberland et al. | |
| 5,194,013 | A * | 3/1993 | Propp | H01R 13/6392 439/102 |
| 5,573,420 | A * | 11/1996 | Grosswendt | H01R 13/6392 24/16 PB |
| 5,785,547 | A * | 7/1998 | Cross | H01R 13/6392 439/369 |
| 6,080,004 | A * | 6/2000 | Kovacik | H01R 13/6392 439/352 |
| 6,997,734 | B1 | 2/2006 | McQuirter | |
| 7,077,683 | B1 * | 7/2006 | Ross | H01R 13/20 439/346 |
| 7,484,990 | B1 * | 2/2009 | Lee | H01R 13/585 439/369 |
| 8,808,014 | B2 * | 8/2014 | Hsu | H01R 24/28 439/144 |
| 8,956,175 | B2 | 2/2015 | Makrinos | |
| 9,077,111 | B2 | 7/2015 | Brown | |
| 10,141,690 | B2 * | 11/2018 | Bozikis | H01R 13/6392 |
| 10,320,122 | B2 * | 6/2019 | Bozikis | H01R 13/6392 |
| 11,005,214 | B2 * | 5/2021 | Edwards | H01R 13/635 |
| 11,038,305 | B1 * | 6/2021 | Sampaio | H01R 13/627 |
| 11,128,089 | B2 * | 9/2021 | Blunt | H01R 13/60 |
| 2014/0045357 | A1 | 2/2014 | Nugent | |
| 2017/0331225 | A1 | 11/2017 | Bozikis | |
| 2021/0203102 | A1 * | 7/2021 | Lalinde | H01R 13/639 |

* cited by examiner

RETENTION DEVICES

BACKGROUND

An electrical connector can be an electro-mechanical device used to join electrical terminals and create an electrical circuit. Electrical connectors can have plugs and jacks. In some examples, a plug can be a male ended electrical terminal and a jack can be a corresponding female ended electrical terminal. The connection of the plug and jack may be temporary. That is, the plug and jack can be removed using a force to separate the plug and jack to disconnect the electrical circuit.

DETAILED DESCRIPTION

Systems and devices for a connector housing with a retention device are described herein. A connector housing can be used to join electrical terminals and create an electrical circuit between cables, devices, and/or combinations thereof.

In some examples, a connector housing can include conductive terminals that can couple wires or cables to a corresponding conductive terminal of the connector housing. As used herein, the term "connector housing" refers to a device that acts as an enclosure for a connection between a wire or cable and a conductive terminal. The connector housing can be an enclosure coupled to an end of a first cable to connect the first cable to a second cable with a corresponding connector housing. For example, the first cable can include a connector housing with a conductive terminal that is a plug. In this example, the second cable can include a connector housing with a conductive terminal that is a jack that can be correspondingly shaped to receive the plug such that the first cable and the second cable can be electrically connected together when the plug and jack are coupled together. A connection between connector housings can be a non-permanent electrical connection. Since the connection is non-permanent, the connection between the connector housings can be disconnected accidently when the connector housings and/or cables are kicked, pulled, and/or extended causing systems attached to the cables to crash, such as when the cables provide power.

In some examples, a server rack can include a plurality of computing devices that each include a plurality of electrical cables and/or communication cables that can utilize different types of connector housings. In some examples, the connector housings of the server rack can be accidently disconnected and cause failures for the computing devices.

In some examples, a retention device can be utilized to provide a relatively stronger connection in order to prevent accidentally disconnecting a connection between connector housings. In some examples, the retention device can be coupled directly to a first connector housing. In these examples, the retention device can extend from the first connector housing to a cable portion coupled to a second connector housing. In some examples, the retention device can be coupled to the cable portion utilizing an aperture that surrounds a portion of the cable. In this way, the retention device can prevent the first connector housing from being removed from the second connector housing, which can prevent a user from accidentally disconnecting the first connector housing from the second connector housing.

Figure 1:
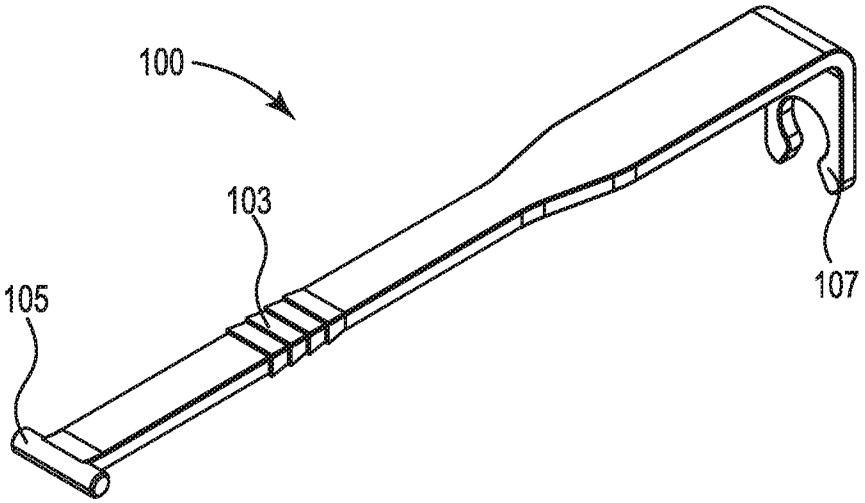
FIG. 1 illustrates an example of a retention device according to the disclosure.

FIG. 1 illustrates an example of a retention device 100 according to the disclosure. The retention device 100 can include an extension shaft 103. In some examples, retention device 100 can include a first end 105 and a second end 107. Each end of retention device 100 can be coupled to a connector housing. Retention device 100 can provide high impact strength, making the connector housing to cable connection, cable to cable connection, and/or connector housing to connector housing connection resilient. Retention device 100 can be connected to a first connector housing by coupling one end to the first connector housing.

In some examples, a first end 105 of retention device 100 can be coupled to a first connector housing (not illustrated in FIG. 1). In other examples, a second end 107 of retention device 100 can be coupled to a second connector housing (not illustrated in FIG. 1). The first end of retention device 100 can pivot about a coupling point of the connector housing. Pivoting allows the second end 107 to be attached to a connector housing adding resilience between retention device and connector housing connection. The coupling point of the connector housing can be the point where retention device 100 is attached to and/or molded into the connector housing. In some examples, the coupling point can lock the retention device with the connector housing.

As illustrated in FIG. 1, first end 105 of retention device 100 can be located at an opposite side of second end 107 of the retention device. First end 105 of retention device 100 can include two opposing pins. As used herein, the term "pin" refers to a pointed or penetrating element used to fasten, support or attach things.

Figure 2:
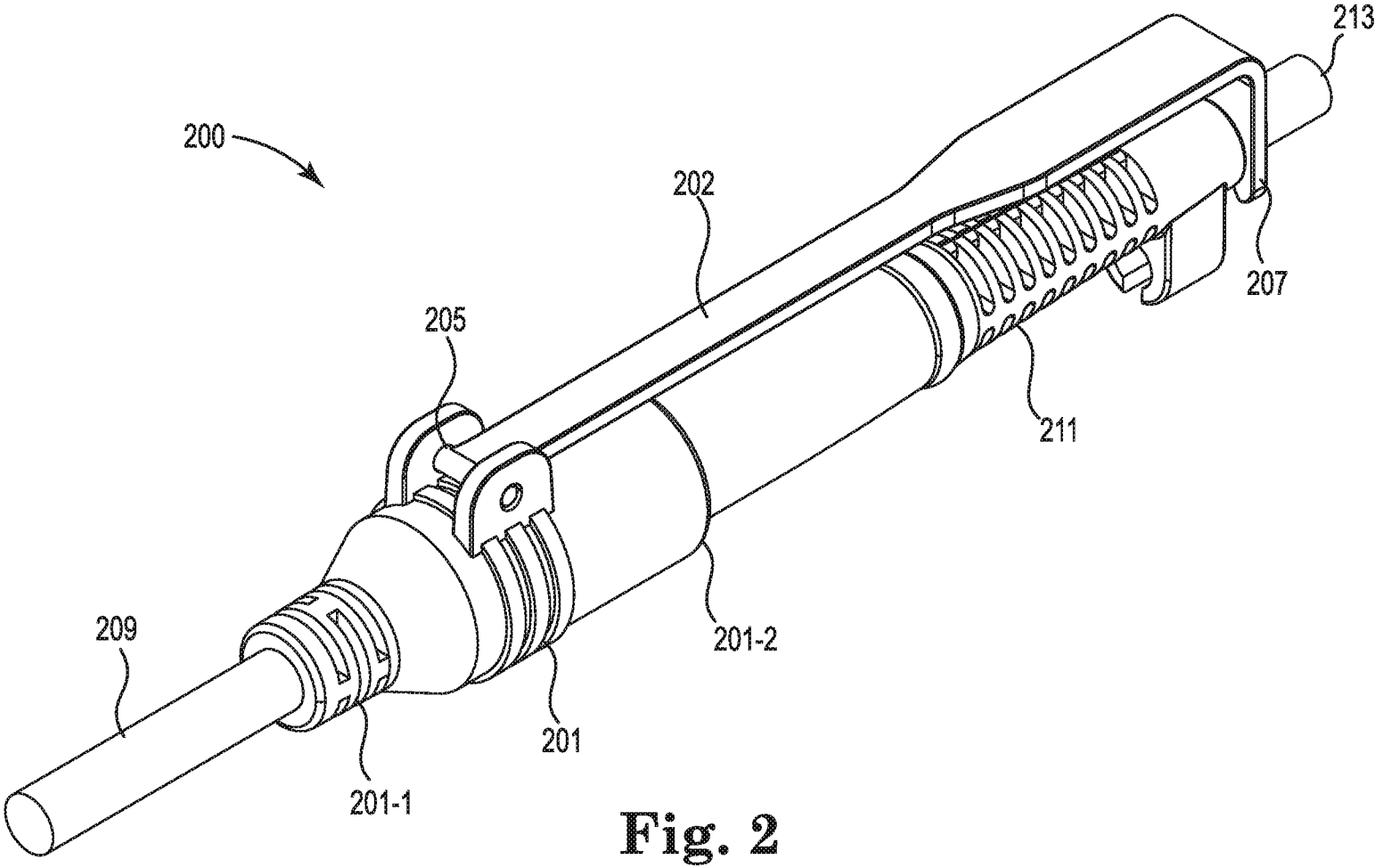
FIG. 2 illustrates an example of a system according to the disclosure.

In some examples, the opposing pins can interlock the retention device with a housing connector, as described herein. In some examples, the pins can include sharp tips to penetrate the connector housing and fasten the first end 105 with the connector housing. The opposing pins of retention device 100 can engage with apertures molded into a connector housing. In some examples, opposing pins of retention device 100 at first end 105 can be compressible into apertures molded into the connector housing, as illustrated in FIG. 2.

In some examples, first end 105 of retention device 100 can be coupled to a connector housing. A connector housing can connect a first cable at a first side of the connector housing, as described herein. In some examples, one end of the connector housing can be shaped to receive first end 105 of retention device 100. For instance, apertures can be molded into connector housing adjacent to first side 105 of the connector housing. Apertures on first side of the housing connector can be shaped to receive the opposing pins of retention device 100.

As illustrated in FIG. 1, retention device 100 can have a second end 107. Second end 107 can have an aperture. A cable can be inserted into the aperture of the second end 107 and lock retention device 100 to the cable. In some examples, aperture at second 107 can be coupled to a second connector housing (not illustrated in FIG. 1). Second connector housing can have a second cable connected to the second connector housing. Retention device 100 can be coupled to the second connector housing at one end and first connector housing at another end to strengthen the connection between the first and the second connector housing when the two housings are connected to each other.

In some examples, the first connector housing and the second connector housing can connect a first cable and a second cable. In some examples, the first cable and the second cable can include conductive wires that are capable of transmitting electrical power and/or communication signals. In other examples, the first cable can include a protective covering such as a resistive plastic material to protect the conductive wires.

In some examples, retention device 100 can include an extension shaft 103. The extension shaft 103 can alter the length of retention device 100 based on the length of a cable connected to the connector housing. For example, shaft 103 can be elongated if the length of a cable connected to the connector housing has to be extended. In some examples, shaft 103 can be shortened if the length of the cable attached to the connector housing, for example, has to be reduced in length. Extension shaft 103 can be made of thermoplastic and/or metal, among other materials. Extension shaft 103 can include ratchets to extend or shorten the length of the extension shaft 103 based on the length of a cable.

FIG. 2 illustrates an example of a system 200 according to the disclosure. In some examples, system 200 can include a retention device 202, a first connector housing 201, and a second connector housing 211. Retention device 202 can include first end 205 and second end 207. First connector housing 201 can include a first side 201-1, second side 201-2, and can be connected to first cable 209. Second connector housing 211 can be connected to second cable 213. In some examples, the first cable 209 can include conductive wires that are capable of transmitting electrical power and/or communication signals. In some examples, the first cable 209 can include a protective covering such as a resistive plastic material to protect the conductive wires.

The first cable 209 can be coupled to the first connector housing 201. The first connector housing 201 can receive and couple the first cable 209 at a first side 201-1 of the first connector housing 201. In some examples, the first connector housing 201 can include a first conductive terminal that is coupled to a second side 201-2 of the first connector housing 201. The first end of the connector housing 201 and the second end of the connector housing 201 can be at opposite ends of the connector housing 201. In some examples, first connector housing 201 can be coupled to a second connector housing 211.

In some examples, first connector housing 201 can have a second side 201-2, opposite to the side the first conductive terminal is coupled to. The second side 201-2 of the first connector housing 201 can receive and couple a second connector housing 211. In some examples, second connector housing 211 can be removably attached to first connector housing 201. For example, the first connector housing 201 can have an exterior surface, an aperture, an extended portion, a socket, and/or interior groves. The socket and/or interior grooves can be shaped to receive a portion of the second connector housing 211. In some examples, the second connector housing 211 can stay in locked position with the first connector housing 201. The locked position fastens and secures the first connector housing 201 and the second connector housing 211 together, securing the two connector housings. In some examples, second connector housing 211 can be released from the attachable position with first connector housing 201. For example, second connector housing 211, while attached to first connector housing 201, can be pivoted upwards about first end 205 to be released from its attachable position. In some examples, first connector housing 201 and second connector housing 211 can be mounted together.

In some examples, first connector housing 201 can have a first side 201-1 and a second side 201-2. First side 201-1 of connector housing 201 can receive a cable and/or can be connected to another connector housing. Although first connector housing 201 and second connector housing 211 are illustrated in FIG. 2 as being connected to each other, examples of the disclosure are not so limited. For example, multiple connector housings can be connected to each other. For instance, first connector housing 201 can be connected to a third connector housing (e.g., not illustrated in FIG. 2) and/or second connector housing 211 can be connected to a fourth connector housing (e.g., not illustrated in FIG. 2).

In some examples, a first cable 209 can be connected to first side 201-1 of connector housing 201. For example, an aperture can be molded into connector housing 201 adjacent to first side 201-1 where connector housing 201 can receive first cable 209. The cable connecting to first side 201-1 can be determined based on the diameter and shape of the aperture of connector housing 201. Second connector housing 211 can be coupled to the first connector housing.

In some examples, second connector housing 211 can be coupled to second side 201-2 of the first connector housing 201. Second side 201-2 can be on the opposite side of first side 201-1 of first connector housing 201. In some examples, second connector housing 211 can be connected to a second cable 213. Second cable 213 can be coupled to the second connector housing 211 on the opposite side from where second connector housing 211 couples with first connector housing. In some examples, first cable 209 and second cable 213 can be, XLR connectors, 4-pin Mini DIN S-Video cables, power cables, and/or other types of cables.

As described herein, first connector housing 201 can be connected to a second connector housing 211. In some examples, an aperture can be molded into first connector housing 201 adjacent to second side 201-2 where connector housing 201 can be connected to a second connector housing 211. First connector housing 201 and second connector housing 211 can be terminal type electrical connectors that connect wires to a single connection point. Other examples of the connectors can be plug and socket connectors, 8P8C connectors, USB connectors, power connectors, D-subminiature electrical connectors, radio frequency connector and/or DC connectors. In some examples, connector housings 201 and 211 can be crimp on connectors.

In an example in which connector housings 201 and 211 are crimp on connectors, to crimp the connector housings, two pieces of connector housings can be joined together by shaping one or both of the connector housing to hold the other. For example, first connector housing 201 can be shaped to have an extended portion and second connector housing 211 can be shaped to have a socket to crimp the first connector housing to the second connector housing. In other examples, connector housings can be crimped, for example, by shaping second connector housing based on the diameter of the first connector housing. For example, second connector housing can be shaped at ¼ inch of the diameter of first connector housing 201 to fit into the first connector housing. Crimping of the connector housings make connections of the connector housings resilient and prevents them to be disconnected unintentionally.

In some examples, system 200 can include a retention device 202. In some examples, retention device 202 can include a first end 205 and a second end 207. Each end 205 and 207 of retention device 202 can be coupled to a connector housing. Retention device 202 can provide high impact strength, making the connector housing to cable connection, cable to cable connection, and/or connector housing to connector housing connection resilient. Retention device 202 can be connected to a first connector housing 201 by coupling first end 205 to the first connector housing 201 and can be connected to the second connector housing 211 by coupling second end 207 to second cable 213 that is coupled to second connector housing 211, as is further described herein.

The first end 205 of retention device 202 can be coupled to a first connector housing 201. In some examples, first end 205 of retention device 202 can include two opposing pins which can fit into molded apertures of first connector housing 201. In some examples, the pins can include sharp tips to penetrate the connector housing and fasten the first end 205 with the connector housing. In some examples, first connector housing 201 can be shaped to receive the first end of 205 of retention device 202. For example, apertures can be molded into first connector housing 201 to receive opposing pins of retention device 202, as described herein. In some examples, apertures can be molded into connector housing 201 between the first side 201-1 and second side 201-2 of first connector housing 201. Retention device 202 can be locked with the connector housing 201 where the connector housing receives first end 205 of retention device 202. The first end 205 of retention device 202 can pivot about the point where it is coupled to the first connector housing 201.

In some examples, first end 205 of retention device 202 can be located at an opposite side of second end 207 of the retention device. In some examples, retention device 202 can have a second end 207. Second end 207 can have an aperture that can be slid over second cable 213 and lock retention device 202 to cable 213. For example, a second cable 213 can be connected to second connector housing 211. Retention device 202 can be coupled to the second connector housing by inserting aperture 207 to second cable 213.

Retention device 202 can be attached to first connector housing 201 at first end 205. Retention device 202 can be attached to second connector housing 211 at second end 207. Retention device 202 can strengthen the connection between the first and the second connector housing when the two housings are connected to each other.

In some examples, retention device 202 can include an extension shaft 203. The extension shaft can alter the length of retention device 202 based on the length of a cable connected to the connector housing retention device 202. For example, shaft 203 can be elongated if the length of the second cable 213 has to be extended. In some examples, shaft 203 can be shortened if the length of the second cable 213 attached to second connector housing 211 has to be reduced in length. Extension shaft 203 can include ratchets to move the retention device up and/or down in direction based on the length of second cable 213.

In some examples, retention device 202 can be molded into the connector housing 201 that attaches to first cable 209. In one example, retention device 202 can be molded into connector housing 201 using a single injection mold. In some examples, using single injection molding, the connector housing and the retention device can be shaped and customized to affix to each other. In some examples, single injection molding can help with getting more details, for example, getting a rectangularly shaped, a rounded shape and/or other shape connector housing to fit into a corresponding connector housing, as described herein. Molding the retention device and the connector housing can enhance the strength of the attachment point.

Figure 3:
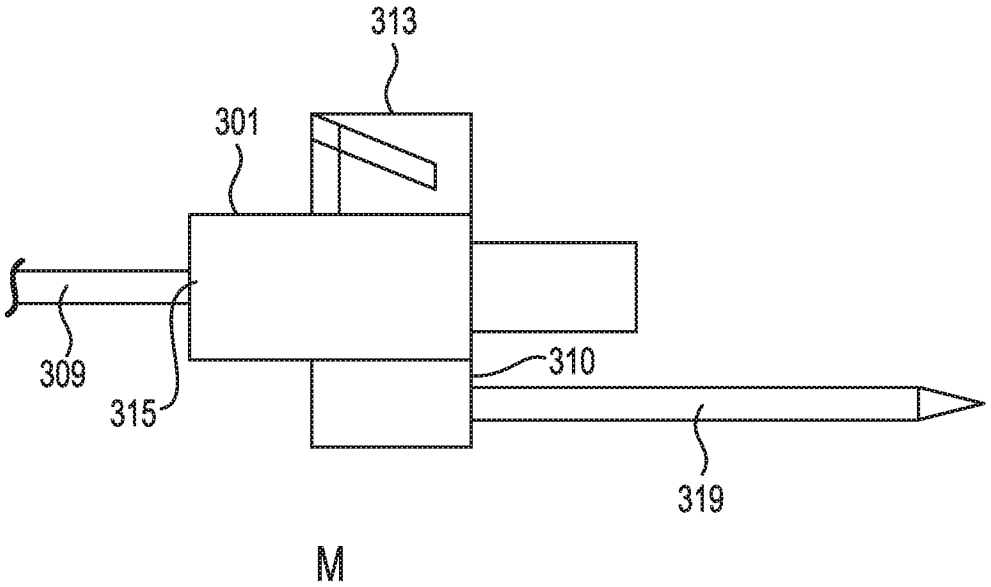
FIG. 3 illustrates an example of a connector housing according to the disclosure.

FIG. 3 illustrates an example of a connector housing 301 according to the disclosure. In some examples, connector housing 301 can include first side 310, first socket 313, third side 315, extended portion 319. Connector housing 301 can be connected to first cable 309.

In some examples, extended portion 319 can be connected to a socket of a corresponding housing. Extended portion, for example, can be unshielded terminal and constructed in a way to be inserted snugly into a receptacle of a corresponding terminal. Socket refers to a receptacle that receives and holds the extended portion. In some examples, extended portion 319 can be couplable to a socket of a corresponding connector housing. Thus, the extended portion can engage two connector housings, as described herein. In other examples, extended portion 319 can be couplable to a socket of an outlet. Thus, first extended portion 319 can engage housing connector 301 to an outlet directly.

In some examples, first extended portion 319 can be coupled to a first side 310 of first connector housing 301. In some examples, first housing connector 301 can include a first socket 313. Socket 313 can be a female socket. In some examples, socket 313 can receive an extended portion of a corresponding connector housing.

In some examples, connector housing 301 is connected to first cable 309. For instance, first cable 309 is coupleable to connector housing 301. As used herein, "coupleable", refers to an ability of a cable and a connector housing to be attached together. In some examples, the cable is capable of rotating relative to connector housing. In some examples, first cable 309 can be located on a third side 315 of the first connector housing 301. In some examples, third side 315 of first housing 301 is opposite of first side 310 of first connector housing 301. In some examples, first cable 309 can be connected to a device, an outlet, and/or another cable.

In some examples, first extended portion 319 is positioned opposite of a socket of corresponding housing (not illustrated in FIG. 3). In some examples, first extended portion 319 and the corresponding housing connector's socket can be on the same side. In some examples, a socket of the corresponding housing can receive extended portion 319 and connect the first connector housing 301 with the corresponding housing. Corresponding housing can be an analogous and/or compatible connector housing.

In some examples, first socket 313 can receive an extended portion of a corresponding housing (not illustrated in FIG. 3). Receiving the extended portion of the corresponding housing can connect first connector housing 301 to the corresponding connector housing.

Extended portions and sockets of connector housings can be shaped to support other connector housings. For example, first socket 313 of first connector housing 301 can be rectangularly shaped to receive and lock a rectangular shaped second extended portion of a corresponding housing. In some examples, a socket of a corresponding connector housing can be a rounded shaped to receive and lock rounded shaped first extended portion 309 of first connector housing 301. As the extended portion of the first connector housing can be press-fit to the female socket of the corresponding housing, a tightly fit connection can be made.

Figure 4:
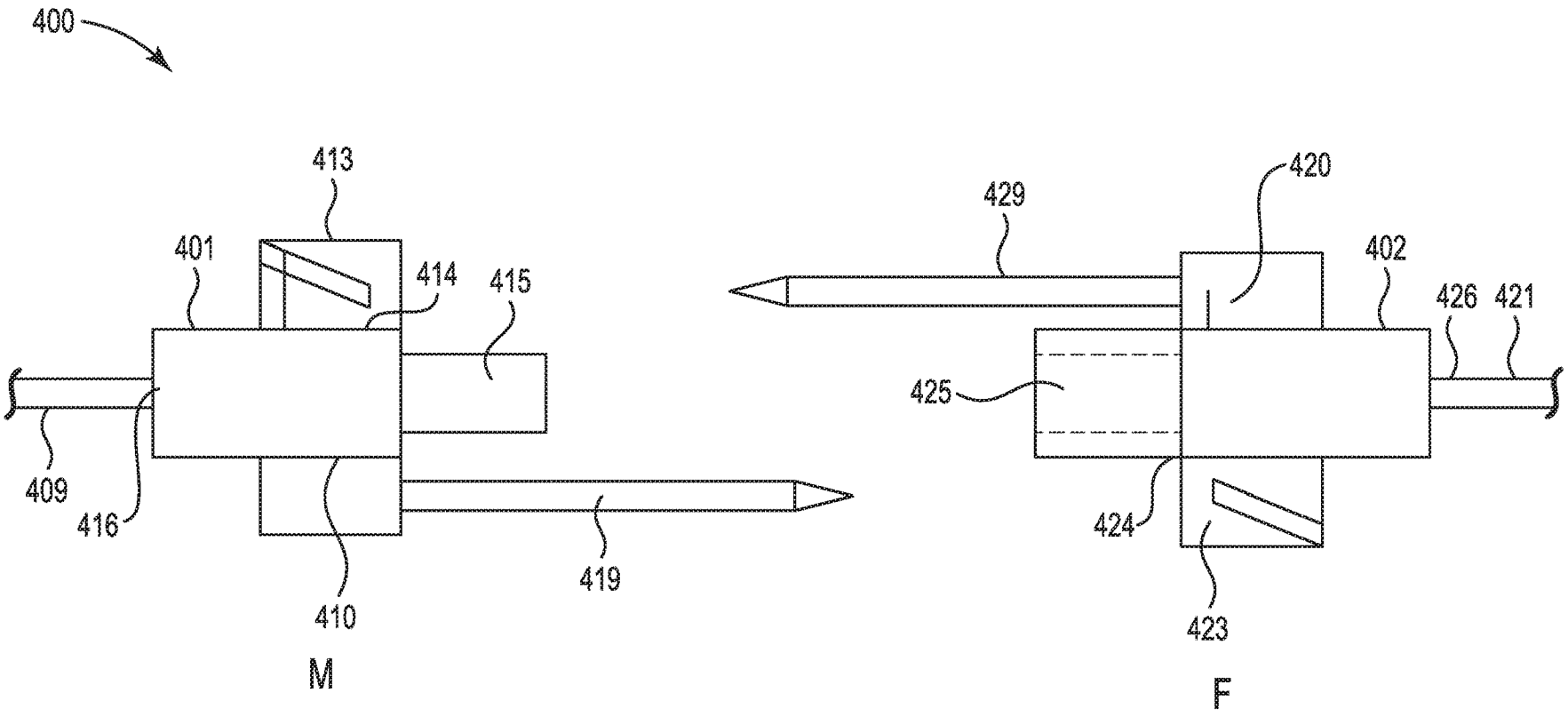
FIG. 4 illustrates an example of a system for connecting connector housings according to the disclosure.

FIG. 4 illustrates an example of a system 400 for connecting connector housings according to the disclosure. In some examples, system 400 can include a first connector housing 401 and a second connector housing 402. The first connector housing 401 can include first side 410, second side 414 third side 415, fourth side 416, first socket 413, first extended portion 419, first cable 409. The second connector housing 402 can include first side 420, second side 424 third side 425, fourth side 426, second socket 423, second extended portion 429, second cable 421.

In some examples, a first connector housing 401 can include a first extended portion 409 and a first socket 413. In some examples, 409 can be molded into the first side 410 of connector housing 401. First socket 413 can be located on second side 414 of connector housing 401.

In some examples, connector housing 401 can include a conductive connector on a third side 415. In one example, third side 415 is located between first side 410 and second side 414 of connector housing 401. In some examples, connector housing 401 can have a fourth side 416. In some examples, fourth side 416 is located on the opposite side of third side 415. In some examples, fourth side 416 can connect a first cable 409.

In some examples, a retention device, as described in FIG. 1, can be connected with first connector housing 401. In some examples, a retention device can be directly molded into connector housing 401. In some examples, one end of a retention device can be coupled with a first cable 409 connected with fourth side 416 of connector housing 401. The retention device can provide high impact strength, making the connector housing to cable connection, cable to cable connection, and/or connector housing to connector housing connection resilient. In some examples, a retention device can make connector housing 401 to cable 409 connection resilient and prevent the cables to be disconnected unintentionally.

In some examples, a second connector housing 402 can include a second extended portion 429 and a second socket 423. In some examples, extended portion 429 can be molded into first side 420 of connector housing 402. In some examples, socket 423 can be located on second side 424 of connector housing 402.

In some examples, connector housing 402 can include a conductive connector on a third side 425. In some examples, third side 425 is located between first side 420 and second side 424 of connector housing 402. In some examples, connector housing 402 can have a fourth side 426. In some examples, fourth side 426 is located on the opposite side of third side 425. In one example, fourth side 426 can be connected to a first cable 421.

In some examples, a retention device, as described in FIG. 1, can be connected with housing device 402. A retention device can be directly molded to connector housing 402. In some examples, one end of a retention device can be coupled with a first cable 421 connected with fourth side 426 of connector housing 402. The retention device provides high impact strength, making the connector housing to cable connection, cable to cable connection, and/or connector housing to connector housing connection resilient. A retention device can make connector housing to cable connection resilient and prevent the cables from being disconnected unintentionally.

In some examples, system 400 can couple first connector housing 401 to to second housing 402. For example, first extended portion 419 of first connector housing 401 connects with the second socket 423 of second connector housing 402. In another example, second extended portion 429 of the second connector housing 402 can connect with first socket 413 of first connector housing 401.

In some examples, first connector housing 401 can include a first retention device to secure the first cable 409 to the first connector housing 401. As described herein, cable 409 can be coupled on fourth side 416 of first connector housing 401. In some examples, first cable 409 can be connected to a device, a power outlet, and/or another cable.

In some examples, second connector housing 402 can be coupled to the retention device, as described herein, to secure the second cable 421 to the second connector housing 402. In some examples, cable 421 can be coupled on fourth side 426 of the second connector housing 402. In some examples, second cable 421 can be connected to a device, a power outlet, and/or another cable.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to any number of such elements and/or features.

What is claimed:

1. A retention device comprising:

a first end coupled to a connector housing of a first cable;

a second end removably coupleable to a second cable to lock the first cable to the second cable when the first cable and the second cable are in an engaged position; and an extension shaft, wherein the extension shaft includes two opposing pins to engage with corresponding apertures in the connector housing of the first cable.

2. The retention device of claim 1, wherein the extension shaft is to alter a length of the retention device based on a length of a second connector housing of the second cable.

3. The retention device of claim 1, wherein the first end of the retention device pivots about a coupling point of the connector housing of the first cable.

4. The retention device of claim 1, wherein the connector housing of the first cable is shaped to receive the first end of the retention device.

5. The retention device of claim 1, wherein the second end of the retention device includes an aperture to receive the second cable.

6. A system comprising:

a first cable having a connector housing; and a retention device coupled to the first cable, the retention device comprising:

a first end coupled to the connector housing of the first cable;

a second end removably coupleable to a second cable to lock the first cable to the second cable when the first cable and the second cable are in an engaged position; and an extension shaft, wherein the extension shaft includes two opposing pins to engage with corresponding apertures in the connector housing of the first cable.

7. The system of claim 6, wherein the first end of the retention device pivots about a coupling point between the two opposing pins and the corresponding apertures in the connector housing of the first cable.

8. The system of claim 6, wherein the corresponding apertures further comprise molded corresponding apertures.

9. The system of claim 6, wherein the corresponding apertures are located between a first side and a second side of the connector housing.

10. The system of claim 6, wherein the corresponding apertures are located apertures can be molded into connector housing between the first side and second side of first connector housing.

11. The system of claim 6 wherein the first cable includes conductive wires to transmit electrical power, communication signals, or both.

12. The system of claim 11, wherein the first cable includes a protective covering to protect the conductive wires.

13. The system of claim 12, wherein the protective covering further comprises a plastic protective covering.

14. The system of claim 6, wherein the second end of the retention device includes an aperture to receive the second cable.

15. A system comprising:

a first cable having a first connector housing;

a second cable having a second connector housing; and a retention device; comprising:

a first end coupled to the first connector housing of the first cable;

a second end removably coupleable to the second housing of the second cable to lock the first cable to the second cable when the first cable and the second cable are in an engaged position; and an extension shaft, wherein the extension shaft includes two opposing pins to engage with corresponding apertures in the first connector housing of the first cable.

16. The system of claim 15, wherein the first end of the retention device pivots about a coupling point between the two opposing pins and the corresponding apertures in the first connector housing of the first cable.

* * * * *